United States Patent [19]

Gilbert

[11] Patent Number: 4,586,155

[45] Date of Patent: Apr. 29, 1986

[54] HIGH-ACCURACY FOUR-QUADRANT MULTIPLIER WHICH ALSO IS CAPABLE OF FOUR-QUADRANT DIVISION

[75] Inventor: Barrie Gilbert, Forest Grove, Oreg.

[73] Assignee: Analog Devices, Incorporated, Norwood, Mass.

[21] Appl. No.: 465,798

[22] Filed: Feb. 11, 1983

[51] Int. Cl.[4] ..... G06G 7/16

[52] U.S. Cl. ..... 364/841; 307/498; 328/160; 364/849

[58] Field of Search ..... 364/841, 857, 849; 307/491, 494, 498; 328/160, 161; 363/73

[56] References Cited

U.S. PATENT DOCUMENTS

| | | | |
|---|---|---|---|
| T886,006 | 4/1970 | Nichols | 364/841 |
| 3,432,650 | 3/1969 | Thompson | 364/841 |
| 3,689,752 | 9/1972 | Gilbert | 364/841 |
| 3,838,262 | 9/1974 | Van de Plassche | 364/841 |
| 4,156,283 | 5/1979 | Gilbert | 364/841 |
| 4,353,000 | 10/1982 | Noda | 328/161 |

OTHER PUBLICATIONS

Gilbert et al., "A Wideband Two-Quadrant Analog Multiplier", IEEE International Solid-State Circuits Conference, Feb. 1980, pp. 200-201.

Gilbert, "Analog Multiplier", New Electronics, vol. 10, No. 2, Jan. 1977, pp. 38, 40.

Bradshaw, "A Monolithic 0.1% Pulse Height Duration Multiplier-Divider", 8th Asilomar Conference on Circuits, Systems and Computers, Dec. 1974, pp. 308-313.

*Primary Examiner*—Joseph Ruggiero

*Attorney, Agent, or Firm*—Parmelee, Bollinger & Bramblett

[57] ABSTRACT

A four-quadrant analog multiplier comprising a first pair of transistors to handle one multiplier input and second and third pairs of transistors interconnected with said first pair to effect multiplication. Resistors are connected to the bases of the second and third pairs of transistors, and current which is proportional-to-absolute-temperature is caused to flow through the resistors. The resistors are laser-trimmed until $V_{BE}$ mismatch distortion is nulled. An op amp is used to drive the bases of all three pairs of transistors. A current source is connected to the first pair of transistors, and is separately controlled so as to provide for four-quadrant division. A number of additional features are incorporated to further minimize distortion and to improve performance in other respects.

28 Claims, 11 Drawing Figures

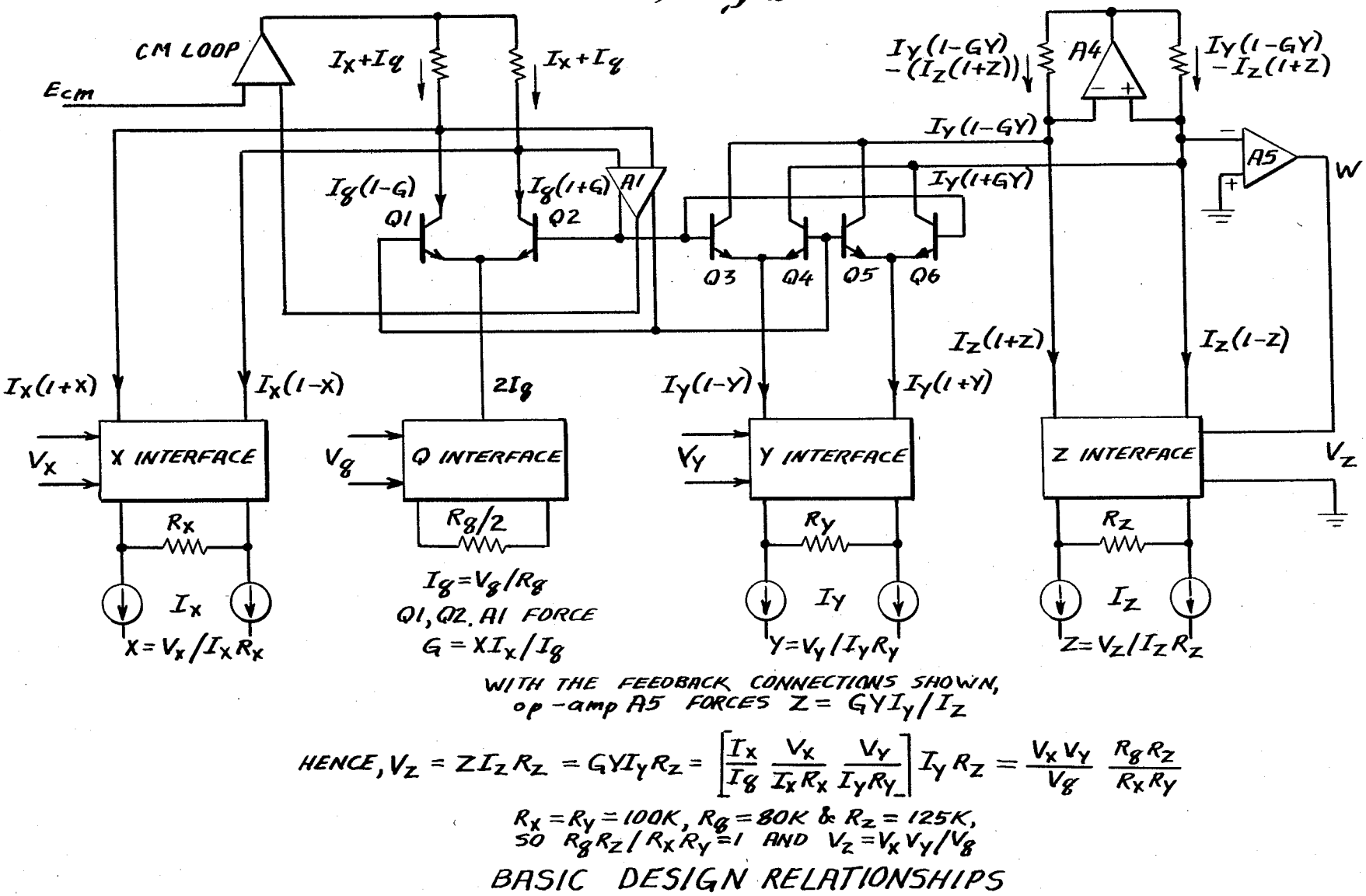
Fig. 9
CM LOOP
$E_{cm}$
$I_X + I_g$
$I_X + I_g$
A1
$I_g(1+G)$
$I_g(1-G)$
Q1
Q2
Q3
Q4
Q5
Q6
$2I_g$
$I_X(1-X)$
$I_X(1+X)$
X INTERFACE
$R_X$
$I_X$
$X = V_X / I_X R_X$
$V_X$
Q INTERFACE
$R_g/2$
$V_g$
$I_g = V_g / R_g$
Q1, Q2, A1 FORCE
$G = X I_X / I_g$
$I_Y(1-Y)$
$I_Y(1+Y)$
Y INTERFACE
$R_Y$
$I_Y$
$Y = V_Y / I_Y R_Y$
$V_Y$
$I_Y(1-GY)$
$I_Y(1+GY)$
$I_Y(1-GY)$
$I_Y(1-GY)$
$I_Z(1+Z)$
$I_Z(1+Z)$
$I_Z(1-Z)$
$I_Z(1+Z)$
A4
A5
W
$V_Z$
Z INTERFACE
$R_Z$
$I_Z$
$Z = V_Z / I_Z R_Z$
WITH THE FEEDBACK CONNECTIONS SHOWN,
op-amp A5 FORCES $Z = G Y I_Y / I_Z$
HENCE, $V_Z = Z I_Z R_Z = G Y I_Y R_Z = \left[\frac{I_X}{I_g} \frac{V_X}{I_X R_X} \frac{V_Y}{I_Y R_Y}\right] I_Y R_Z = \frac{V_X V_Y}{V_g} \frac{R_g R_Z}{R_X R_Y}$
$R_X = R_Y = 100K$, $R_g = 80K$ & $R_Z = 125K$,
SO $R_g R_Z / R_X R_Y = 1$ AND $V_Z = V_X V_Y / V_g$
BASIC DESIGN RELATIONSHIPS

HIGH-ACCURACY FOUR-QUADRANT MULTIPLIER WHICH ALSO IS CAPABLE OF FOUR-QUADRANT DIVISION

BACKGROUND OF THE INVENTION

1. Field of the Invention

This invention relates to monolithic analog multipliers. More particularly, this invention relates to techniques for effecting substantial improvements in performance of four quadrant analog multipliers.

2. Description of the Prior Art

Monolithic analog multipliers have been available for a number of years. Such multipliers have come to be based on a circuit concept referred to as the "Translinear Principle", as described in an article by the present inventor entitled "Translinear Circuits: A Proposed Classification", *Electronic Letters,* Vol. 11, No. 1, p.14, January 1975. Related disclosures are set forth in U.S. Pat. Nos. 3,589,752; 4,075,574 and 4,156,283.

It is known that a small mismatch in the emitter area in a pair of transistors (or, equivalently, a corresponding mismatch in their base-emitter voltages for the same operating conditions) will, in many translinear multiplier circuits, generate significant amounts of undesired nonlinearity, primarily of parabolic form. Typically, it requires an area mismatch of only 0.4%—or a $V_{BE}$ mismatch of about 100 $\mu$V—to introduce 0.2% distortion. While much can be done to maintain good area delineation in IC mask-making, and other steps can be taken to reduce such mismatches as arise from thermal and doping gradients in the IC chip, a practical limit is reached in which the yield of chips having the desired accuracy becomes unacceptably low. Experience has shown that it is difficult to achieve $V_{BE}$ matching much better than 50 $\mu$V on a routine basis, which results in distortion on the order of 0.1%. Many applications would benefit from distortion levels lower than this.

SUMMARY OF THE INVENTION

In preferred embodiments of the invention to be described hereinafter in detail, there are provided techniques for substantially eliminating the distortion, essentially parabolic in form, caused by small mismatches in the base-emitter voltage of pairs of transistors used in analog multipliers. In another aspect of the invention, there is provided an improved method for driving transistors in the "core" of the multiplier so as to reduce distortion arising from finite Early voltage and beta, and simultaneously provide more exact control of scaling (i.e. the denominator) over a very wide dynamic range. Still another feature of the invention provides for operation as a divider in all four quadrants, that is, a circuit whose output is the algebraically-correct quotient of a pair of variables the signs of which are not known in advance.

Other objects, aspects and advantages of the invention will be pointed out in, or apparent from, the following description of preferred embodiments of the invention, considered together with the accompanying drawings.

BRIEF DESCRIPTION OF THE DRAWINGS

FIG. 9 sets forth basic design relationships of a commercial device embodying aspects of the invention.

DETAILED DESCRIPTION OF THE INVENTION

Figure 1:
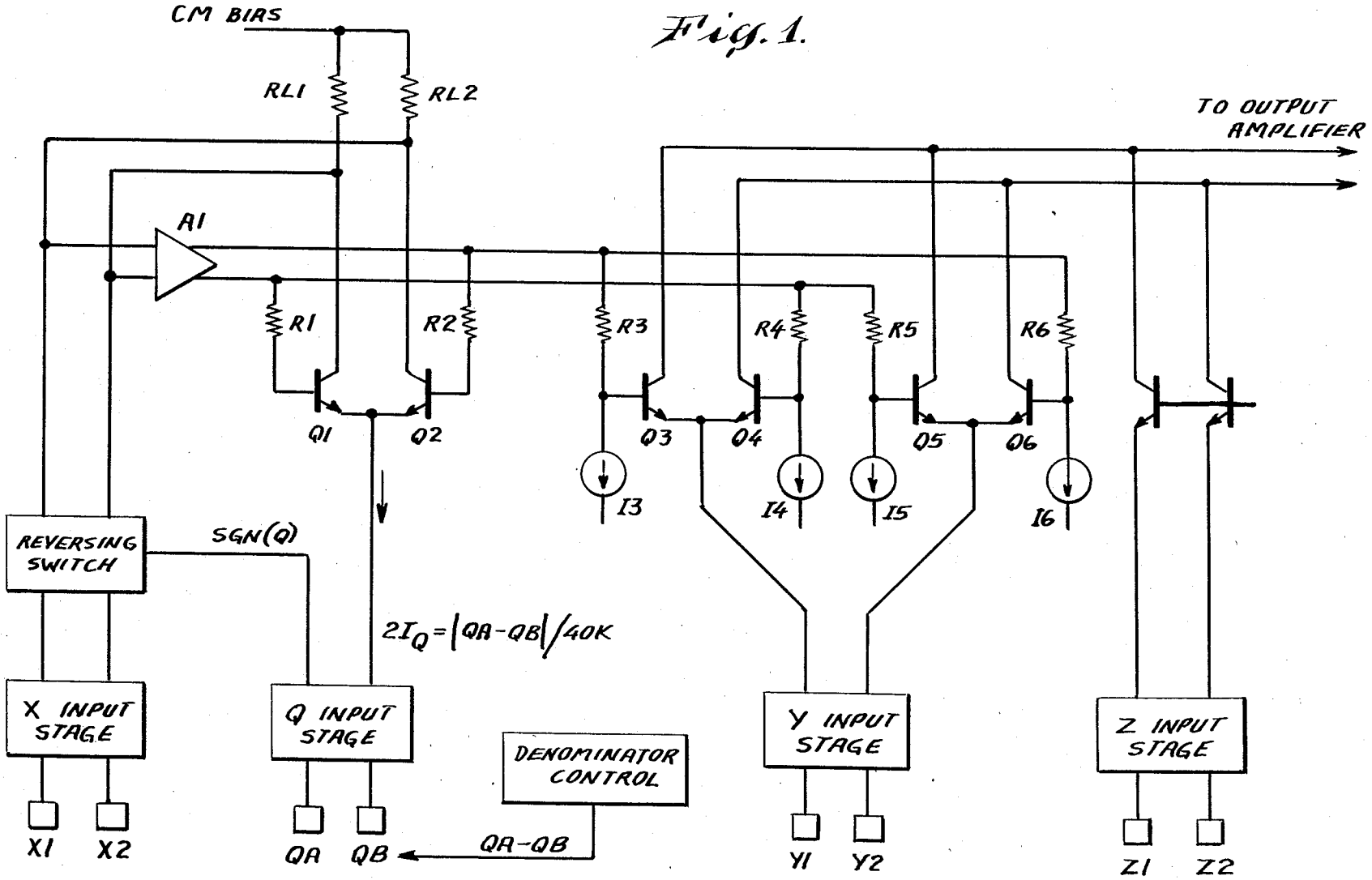
FIG. 1 is a schematic diagram, partly in block format, showing a preferred embodiment of the invention.

FIG. 1 shows the overall arrangement of a multiplier which also provides divider functions as will be described. In comparison with commonly available prior art multipliers, it may be noted that Q1 and Q2, which handle the X-input signal of the multiplier, are not diode-connected and driven at their emitters, but are embedded in a sub-circuit in which their bases are driven by a differential amplifier, A1, having a high open-loop gain and low output resistance. The total emitter current of Q1 and Q2 is not, as is more typically the case, determined by the bias current from the X interface circuit (a voltage-to-current converter, to be discussed later) but by a separate current source, labelled 2Iq, which can be controlled over a range of at least 1000:1 (typically, from 250 nA to 250 $\mu$A).

The bases of the "slave" transistors Q3 through Q6, which handle the Y-input signal, are driven by the amplifier A1, which is able to absorb their base currents without these having any significant effect on the signal currents in Q1 and Q2. The differential output of A1 is coupled to the bases of Q3–Q6 via small resistors R3 through R6, to which current-sources I3 through I6 are applied, thus introducing voltages I3R3, I4R4, I5R5 and I6R6 into the base circuits of Q3–Q6.

The small DC voltages generated across the base resistors by the corresponding current source are arranged to be proportional to absolute temperature (PTAT) and to accurately cancel the $V_{BE}$ mismatch voltages (which are likewise PTAT) generated by the two quads of transistors Q1-Q3-Q4-Q2 and Q1-Q5-Q6-Q2. Since these mismatches are not predeterminable, either the currents or the resistors will be adjusted during manufacture of the multiplier. Such adjustment is carried out while using an appropriately sensitive means to sense both the sign and the magnitude of the distortion products, in accordance with known technology which will not be further discussed here.

Resistors R1 and R2 in the bases of Q1 and Q2 are included to balance the total base-circuit resistance in all the transistors, an arrangement which is helpful in eliminating another type of distortion mechanism. No trim voltages are induced in R1 and R2 in the disclosed embodiment.

In generating sufficiently small PTAT voltages, the resistors R3-R6 should not be too large, in order to avoid excess Johnson noise generation in these very sensitive positions (typically, the gain from the base circuit to the multiplier's final output is about 200). A value of 20Ω has been found to be a realistic upper limit in the preferred embodiment. The PTAT voltage is readily generated by using a low-TC resistor and an easily-generated PTAT current. In a preferred embodiment the n+ emitter diffusion was used for the resistors. This had a sheet resistance of 4 to 5Ω/square and a TCR of about +1300 ppm/°C. at 27° C. A current generator having a TC of about 2000 ppm/°C. at 27° C. was used with such resistors, resulting in a net voltage TC of 3300 ppm/°C., the same as that of a PTAT voltage.

Figure 2:
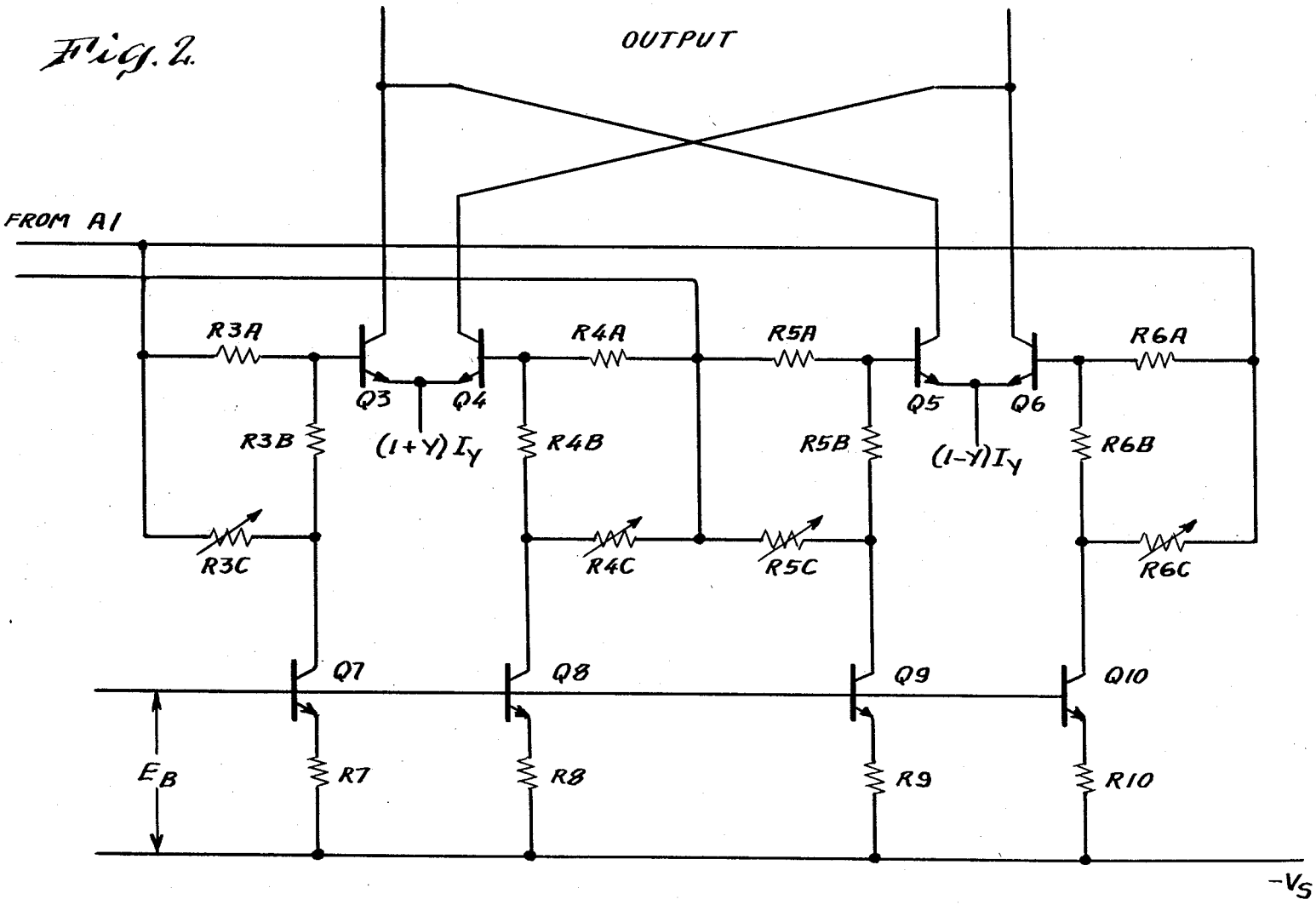
FIG. 2 illustrates a preferred circuit for accommodating adjustment of the PTAT voltages at the transistor bases.

The current sources can be made as shown in FIG. 2, which also shows details of the trimming scheme. The base bias line is a temperature-stable voltage, $E_B$, which in general will be chosen to impart the desired TC to the collector current. In a preferred embodiment, $E_B$ was 1.65 V, which places about 1.00 V across the emitter resistors. Since the $V_{BE}$ of the transistor used in this current source decreases by about 2 mV/°C., the voltage across the resistors, hence the collector currents, increases by 2000 ppm/°C., as required to achieve a PTAT voltage across the n+ load resistors. This type of compensation does not result in an exactly PTAT output voltage, but in practice the approximation is adequate.

It would be possible to adjust the compensation voltages in the base loops by trimming the emitter resistors of the current sources. However, that approach is not as advantageous as that referred to above, and described in detail below.

Referring now to FIG. 2 in more detail, trim resistors R3C through R6C are initially very low in value (about 300Ω) while fixed resistors R3B through R6B are relatively high (about 5KΩ). R3A through R6A are the 20Ωn+ resistors (identified as R3-R6 in FIG. 1) across which the compensation voltages are generated. Prior to trimming, most of the collector current of sources Q7 through Q10 will thus be routed away from the n+ resistors, to the output nodes of A1. For the resistor values used here, the division is such that 94.3% of these currents go directly to A1, and only the residual 5.7% flows in the n+ base resistors. Specifically, in the case of the preferred embodiment, the current sources are each 60 μA (at 27° C.) so that the initial value of all the compensation voltages is only 60 μA×20Ω×0.057 or 68 μV; these voltages will balance to well within 10%, and the residual 7 μV of uncertainty is much below the intrinsic uncertainty in $V_{BE}$ match.

Various techniques can be used to make the appropriate adjustments to the PTAT compensation voltages. In a preferred laser-trim algorithm, when the laser-trim program reaches the appropriate point, signals are applied to the IC which first set the modulation index Y (FIG. 2) to +1. This causes the transistor pair Q5/Q6 to become inactive (since (1−Y)Iy becomes zero), and all of the nonlinearity in the core will be generated by the quad Q1-Q3-Q4-Q2 (referring to FIG. 1). The measurement system associated with the laser-trimmer determines the polarity of the $V_{BE}$ mismatch voltage causing this nonlinearity and directs the laser to trim either R3C or R4C, depending upon the measurement.

As the value of either of these resistors increases, more of the compensation current flows in R3A or R4A, respectively. The appropriate resistor is increased until the distortion for that quad is nulled. In the practical case, the maximum value of the "C" resistors is about 10KΩ, and up to 67% of the current (or 0.67×60 μA=40 μA) flows in the 20Ω "A" resistors, so introducing a maximum compensation voltage of 800 μV (at 27° C.). This is adequate to trim all but the worst-quality ICs, which would be suspect anyway if the $V_{BE}$ match were so poor. The variable Y is then set to −1, rendering the pair Q3/Q4 inactive, and a similar trim procedure effected for the quad Q1-Q5-Q6-Q2.

Figures 3A, 3B, 3C:
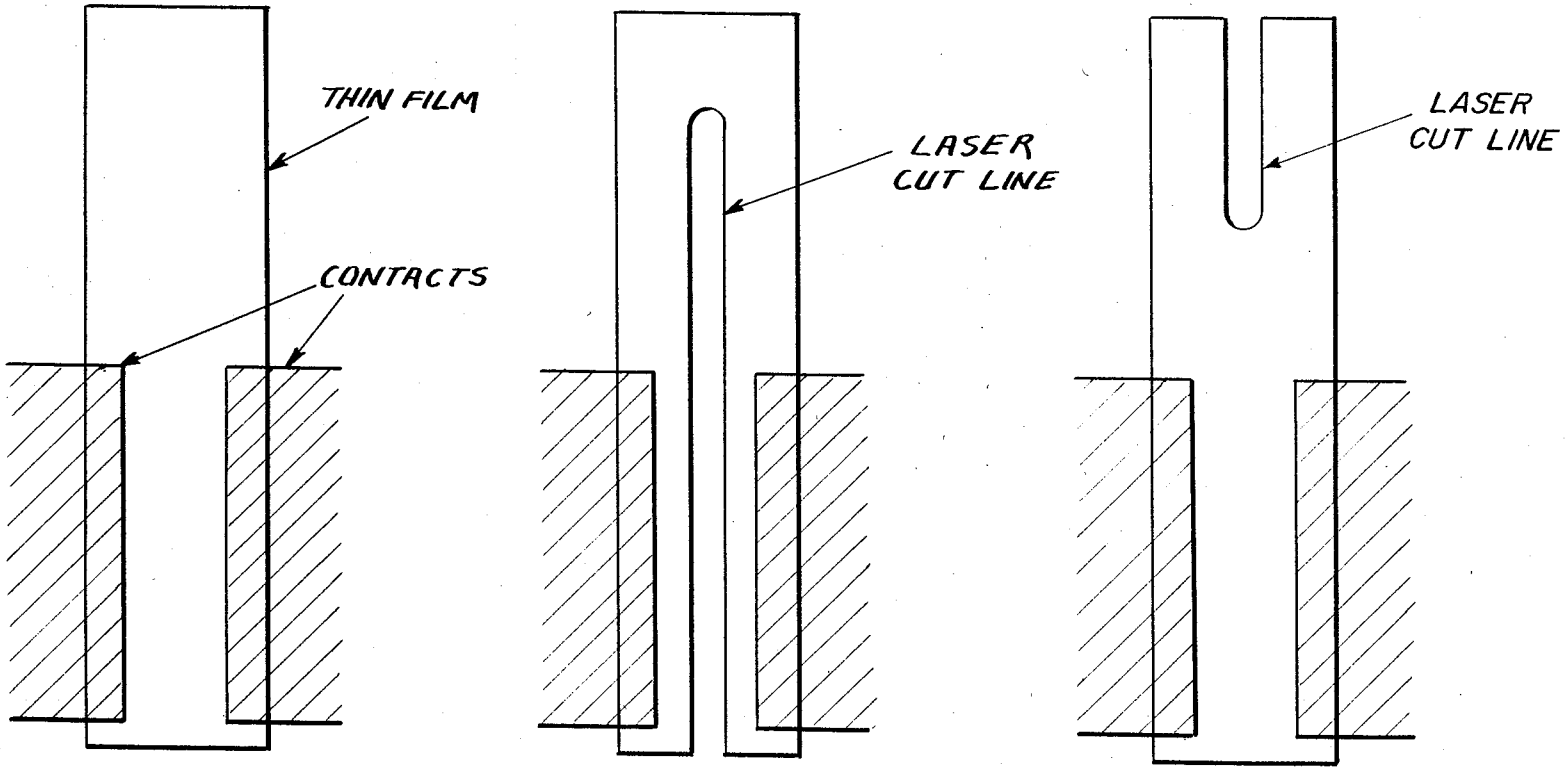
FIGS. 3*a,* 3*b* and 3*c* together show an advantageous IC thin-film resistor arrangement for permitting accurate adjustment of the PTAT voltages.

The design of the "C" resistors must provide an unusually wide trim range (of 300Ω to 10KΩ, in the example cited). FIG. 3 is included to show one way in which this may be achieved. In the initial state (FIG. 3*a*), the majority of current flow is parallel to the two contacts, and the geometry is such that the length-to-width ratio is about 0.3, amounting to 300Ω for a sheet resistance of 1KΩ/square. Coarse trimming is effected by cutting into the region between the contacts, from the bottom up. Once this cut-line extends above the "parallel-flow" region, the current begins to take a more circuitous path, until in the limit, when the cut-line extends to almost the top of the resistor, the geometry more nearly approximates that of a serpentine, and the dimensions are such that its value amounts to ten or more squares (FIG. 3*b*).

Only one of each pair of "C" resistors needs to be trimmed up in value to introduce the compensation voltage into the base circuit. The other resistor in each pair is thus still untrimmed. This affords an opportunity for very high resolution trimming of the compensation voltage, since by trimming into the top of the full geometry the change in resistance is very slight (FIG. 3*c*). Thus, in one preferred trim method, the initial trim adjustment will be made to overshoot the final value somewhat, and thereafter a cut is made into the top of the resistor to approach the final trimmed value with great precision from the other direction.

Referring again to FIG. 2, in the event that it were decided to trim beyond the 800 μV limit (referred to above), it is a simple matter to cut one of the "C" resistors completely open, then trim the other "C" resistor from the other direction. This would work as follows: The measurement system determines that even with 800 μV of compensation voltage the IC will not be fully trimmed with the normal technique. It therefore elects to completely cut, say, R3C, which raises the voltage in R3A to the full 60 μA×20Ω or 1200 μV. Now, by trimming R4C the differential voltage can be reduced again, towards the value required for distortion nulling (unless the IC in question is a hopeless case). This approach does not leave the second resistor available for high-resolution trimming, but it is safe to assume that such would not be called for if the initial $V_{BE}$ matching were poor. The method would be used to yield a large number of devices, but the test software would be designed to flag the fact that a large trim had been necessary, and the chip could automatically be downgraded by laser-engraving with an appropriate symbol in the space provided on the chip for grade-marking.

Figure 4:
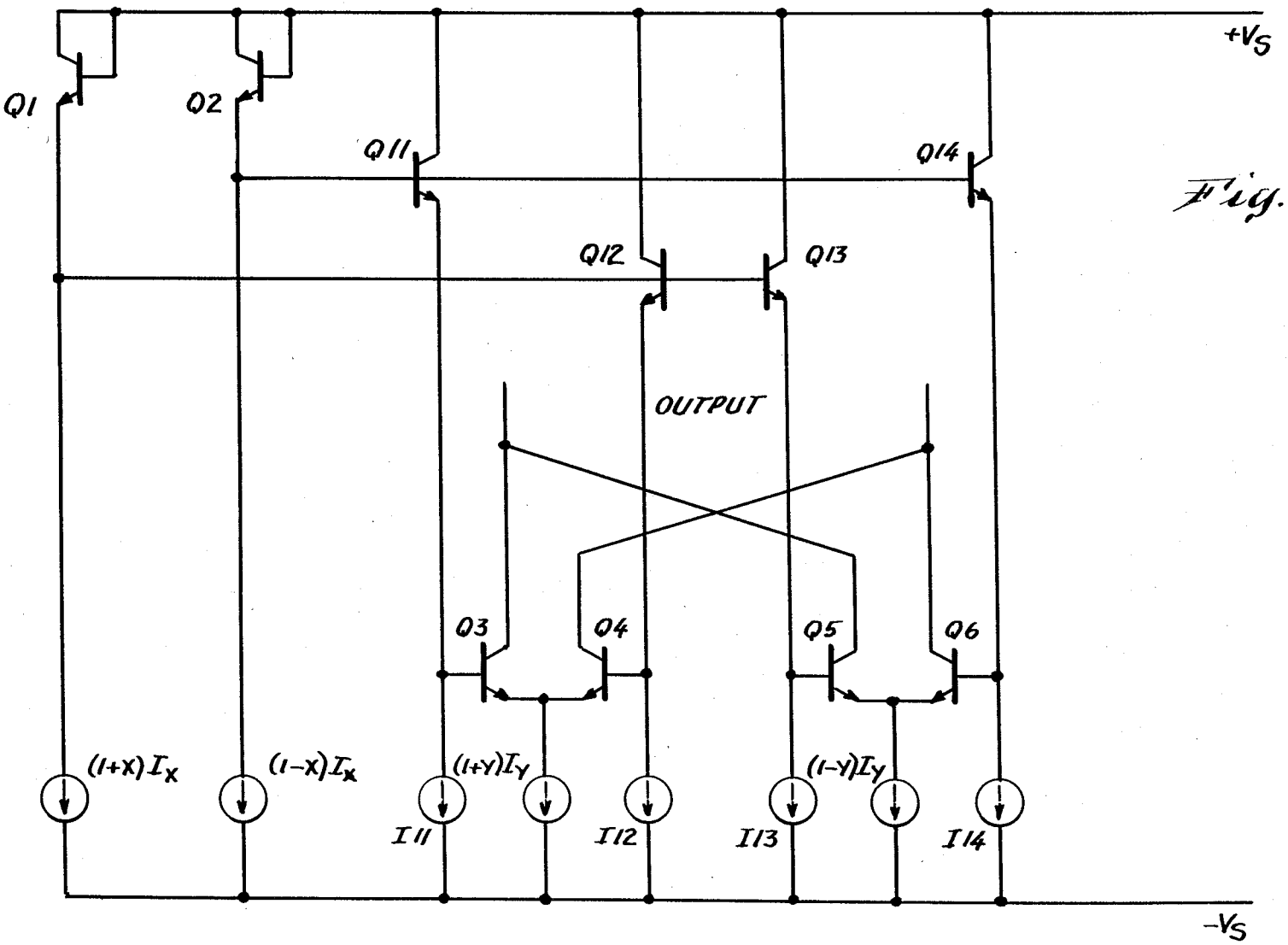
FIG. 4 shows another multiplier arrangement providing important advantages.

FIG. 4 shows another multiplier arrangement. This is structurally similar to commonly available prior art multipliers. That is, Q1 and Q2 are diode-wired with their collectors in common, and the X-input stage (a V-I converter) determines the total bias current to Q1/Q2. FIG. 4 provides the further feature, however, of introducing buffering between Q1/Q2 and Q3-Q6, to effect performance improvements as will be described.

Buffering may be introduced in various ways. In the disclosed embodiment, emitter-followers Q11-Q14 are connected between the emitters of Q1/Q2 and the bases of Q3-Q6. The base currents of Q3-Q6 flow in the emitters of Q11-Q14. The base currents of Q11-Q14 are substantially constant, so they only have the effect of slightly raising the net bias currents Q1/Q2, an effect which can be dealt with in other aspects of the overall design. With the proviso that these currents are substantially less than the emitter bias currents I11-I14, the introduction of buffering provides the advantageous result that small amounts of beta mismatch and beta nonlinearity do not introduce distortion in the final output signal of the multiplier.

An additional feature of the FIG. 4 circuit is that it provides a means for nulling out area-mismatch errors (such as previously described). More specifically, considering the emitter area of any one of the transistors (Qx) to be denoted Ax (where x stands for the transistor number), it will be seen that there are two translinear loops and consequently two area-ratio factors:

$$\lambda 1 = (A1.A12.A4/A2.A11.A3)$$

$$\lambda 2 = (A1.A13.A5/A2.A14.A6)$$

For each quad to be independently linear it is essential for λ1 and λ2 to be exactly unity. However, it can readily be shown that if $$I11/I12 = \lambda 1 \text{ and } I14/I13 = \lambda 2$$

the nonlinearity distortion due to emitter-area mismatch will be nulled. This technique has the advantage of resulting in a temperature-stable adjustment, since it depends only on the ratio of I11 to I12 and I14 to I13, not on their having some special temperature-coefficient of their own. Thus these currents may be fixed, PTAT or of any desired form with regard to their behavior over temperature.

THE X-AMPLIFIER SYSTEM

Figure 5:
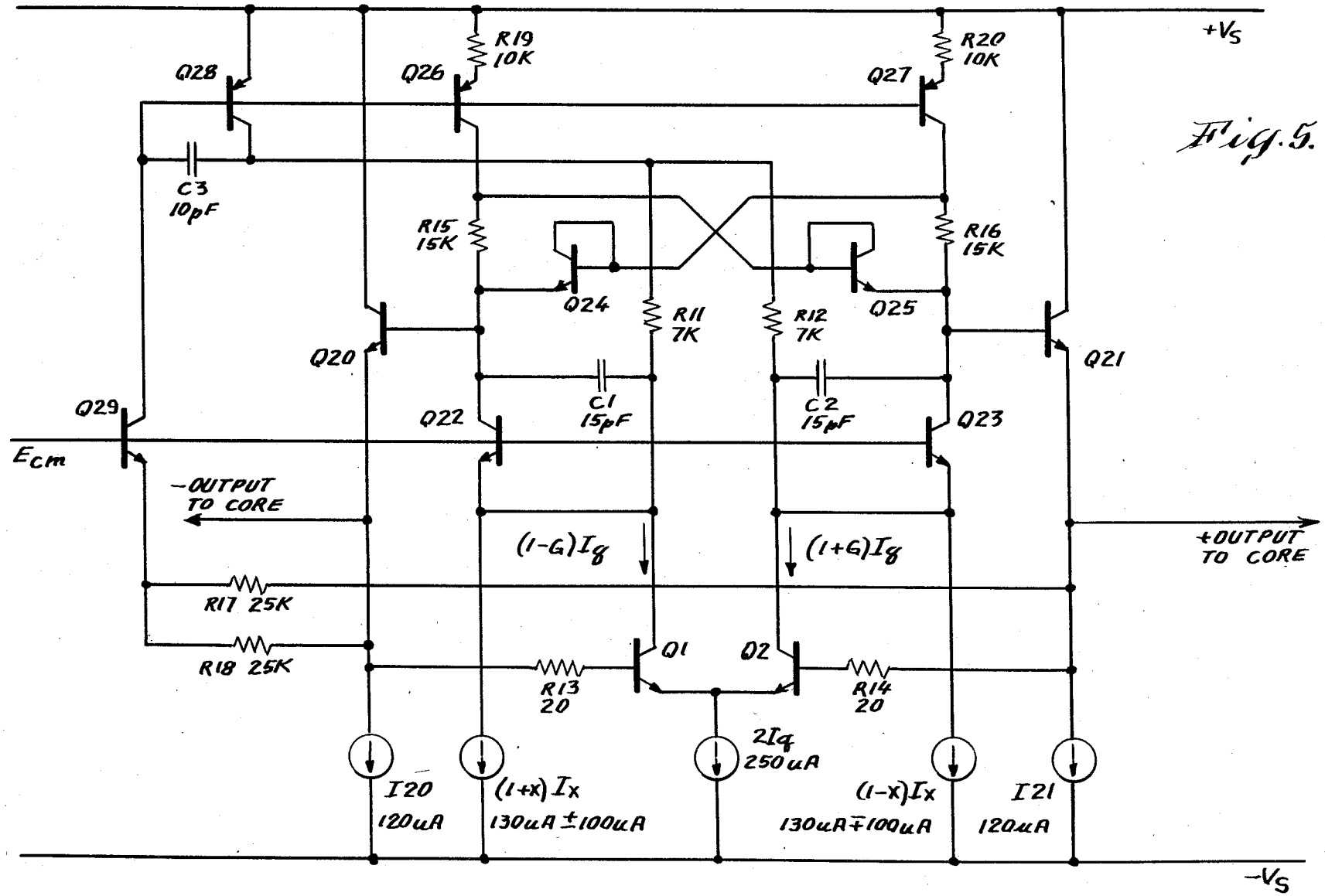
FIG. 5 is a circuit diagram of a preferred amplifier.

Details of the amplifier identified in FIG. 1 as A1 are shown in FIG. 5. A1 is arranged to provide high voltage gain, high bandwidth, low noise, fast overload recovery and be completely differential. Furthermore, the common-mode level at the bases of Q1 and Q2 is held constant as the scaling current ($I_q$) is varied.

In more detail, now, Ix1 and Ix2 are the X signal-currents developed by the X input stage (V-I converter). I20 and I21 are bias currents for the emitterfollowers Q20 and Q21, and come from the $V_{BE}$-trim network (FIG. 2). The differential amplifier proper comprises Q20-Q23; Q24 and Q25 are overdrive clamping transistors; Q26 and Q27 are essentially constant current sources, supplying about 15 μA to bias Q22, Q23. The common-mode control loop comprises Q28, Q29, R17 and R18, and also involves Q26 and Q27.

The X signal input is in the difference of the currents (1+X)Ix and (1-X)Ix, supplied by the X-input V-I converter, where X is a modulation index, normally in the range −0.8 to +0.8 but capable of a peak range of −1 to +1. The scaling current, shown here as 2Iq, is derived from the Q input stage (see FIG. 1), and can be varied over a range as wide as 10,000:1 (typically 250 μA down to 25 nA).

All of the differential X-signal current is forced to be absorbed in the collectors of Q1 and Q2, provided that the scaling current is large enough to support it ( that is, $Iq > |XIx|$), since the currents in the load resistors R11, R12 are forced to be equal by the action of the differential high-gain amplifier, and the bias currents in Q22 and Q23 are also held equal by the inherent symmetry of the design. The collector currents of Q1 and Q2 can be expressed in the form $$Ic1 = (1-G)Iq$$

$$Ic2 = (1+G)Iq$$

where G is also a modulation index in the range −1 to +1. It can be shown that $$G = XIx/Iq$$

that is, it is proportional to X but multiplied by the "gain factor" Ix/Iq, which can be as high as 10,000 at the lower end of the Iq range.

The modulation index, X, actually incorporates Ix, being defined as $$X = Vx/(IxRx)$$

where Vx is the X-input voltage and Rx is the transresistance of the associated V-I converter. Thus, the index G can be redefined as $$G = XIx/Iq = Vx/(IqRx)$$

from which it is apparent that G hits its limits (±1) when $|Vx| = IqRx$.

The overall behavior of the multiplier, of which the above is a part, can be better understood by reference to FIG. 9, labelled "Basic Design Rela- tionships".

With further reference to FIG. 5, $E_{cm}$ is a source of bias voltage developed elsewhere in the system; typically it is 4 V below the +Vs supply line. At poweron there are no currents pulling the circuit nodes towards +Vs, whereas I20, I21, Ix1, Ix2 and Iq all tend to pull the circuit towards −Vs. When the average voltage at the bases of Q1, Q2 falls to a $V_{BE}$ below $E_{cm}$, Q29 turns on Q26-Q28 which establishes the working biases for the amplifier. Most of the common-mode control feedback is via the load resistors R11, R12, since the collector currents of Q26 and Q27 increase proportionately slower than that in Q28, once the working point is attained, due to the presence of R19, R20. This common-mode loop is stabilized by a dominant pole formed by the parallel sum of R17 and R18, and C3. The frequency response of this loop does not need to be very fast, since the X-input V-I converter supplies a signal essentially free from common-mode variation, and Iq is not able to vary very rapidly due to other design constraints in the Q-interface. The net action of this loop is to hold the average voltage at the base of Q1 and Q2 to about one $V_{BE}$ plus 250 mV (the product of half the base current of Q28 and either R17 or R18) below $E_{cm}$.

The differential amplifier has the emitters of Q22 and Q23 as its input port and the emitters of Q20 and Q21 as its output port. The low-frequency differential voltage gain is quite high (typically 1500) so that the differential voltage needed between the bases of Q1 and Q2 to support the X-signal is reduced substantially at their collectors. Thus, Q1 and Q2 operate with essentially equal collector voltages, in the same way that quad of output transistors in the core operate, which eliminates one of several subtle sources of distortion. Also, very little loading effect results from the use of load resistors R11 and R12. Resistors are used in preference to active loads (that is, the use of two PNPs like Q28) because they generate much less noise and are less likely to exhibit mistracking as Iq varies. Also the top of the load network provides a node at which to stabilize the common-mode loop. C1 and C2 improve the HF response by eliminating some of the excess phase associated with Q22 and Q23. The dominant pole in the differential path is generated by the, transistor pair Q1, Q2, since the emitter followers Q20, Q21 have a much higher bandwidth.

Important benefits of using an X-amplifier are as follows: (1) The harmful base currents from the transistors in the output quad are buffered by the beta of Q20 and Q21. These transistors can if desired be converted into double-emitter followers ("Darlingtons") to improve the accuracy at high gains (small values of Iq); (2) No extra noise-generating, thermally-vulnerable junctions are introduced into the primary translinear loop of the multiplier; and (3) The scaling relationships are not affected by the magnitude of the bias currents in the X-input V-I converter, which greatly alleviates many of the problems encountered in earlier designs, one of which is another distortion component (even-order) introduced by the variation of the bias current with the common-mode level of the input signal, resulting from the finite Early-voltage of the current-sources. Also, the need for accurate beta compensation is eliminated.

It may be noted that the scaling current is now delivered to Q1 and Q2 in the core by a completely independent generator, which can supply a more accurate fixed current. With relatively little complexity this generator can be arranged so that the user can set the current level from a denominator-control interface (as illustrated in FIG. 1) to realize three-input multiplication and division.

By forcing the collector currents of Q1 and Q2 (rather than the emitter currents as in earlier multipliers, where the equivalent devices are diode-connected), a basic requirement of translinear circuits is satisfied, namely that the principle depends on the logarithmic dependence between the base-emitter voltage and the collector-emitter voltages in Q1 and Q2, eliminating a distortion mechanism involving Early-voltage modulation of $V_{BE}$.

With continued reference to FIG. 5, it will be seen that Q24 and Q25 clamp the collector voltages of Q22 and Q23 during overdrive conditions, and R15 and R16 serve to advance the onset of clamping and thus limit the differential voltage swing at the base of Q1 and Q2 to a peak value of about 500 mV.

PROVISIONS FOR OPERATING AS A DIVIDER IN FOUR-QUADRANTS

Figure 6:
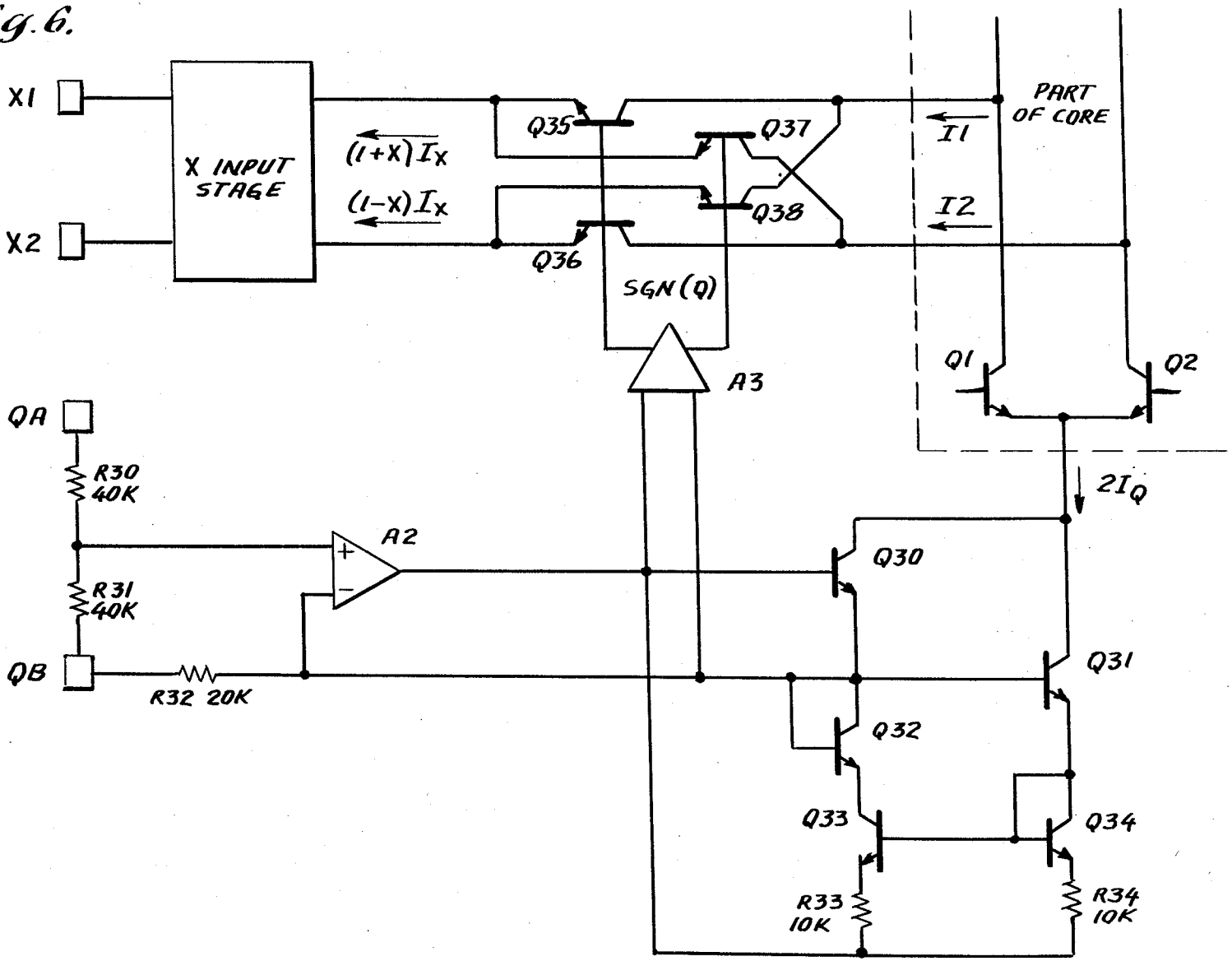
FIG. 6 shows a circuit arrangement for controlling the sign of one of the multiplier inputs.

FIG. 6 shows the main elements Q of the Q interface. The circuit provides for sensing of the sign of the variable Q, thereby to control the polarity of the X-signal so as to result in an algebraically-correct signal for the overall transfer equation.

The current $I_q$ is controlled by an absolute-value circuit, in effect a full-wave rectifier. A2 is an op amp which receives at its positive input-node half of the differential input voltage QA-QB. By reason of the feedback paths through either Q30 (when the voltage QA-QB is positive) or the current mirror Q31-Q34 and R33, R34 (when the voltage QA-QB is negative), this input voltage is placed across the 20KΩ resistor R32. The current 2Iq is thus equal to the magnitude of (QA-QB)/(2R32), being typically 250 μA at a full-scale input of ±10 V.

The magnitude and sign of QA-QB can be user-controlled in any convenient fashion, illustrated in FIG. 1 as "Denominator Control". When the net Q input is positive, the base of transistor Q30 is more positive than its emitter, and the comparator A3 (which has both differential inputs and outputs) is arranged to generate an output such as to cause the bases of current-mode switching transistors Q35, Q36 to be more positive than those of Q37, Q38. Thus the X-signal currents are steered to the core with a phasing such that $$I1=(1+X)Ix$$

$$I2=(1-X)Ix$$

and the overall system design is such that with this phasing the net sign of the transfer function is positive.

Conversely, when the Q input is negative, and the current-mirror is active, the polarity of the input to A3 is reversed, and consequently switch transistors Q37, Q38 conduct the X signal, $$I1=(1-X)Ix$$

$$I2=(1+X)Ix$$

By thus reversing the X signal, the sign of the final output is reversed, and the circuit is thus responsive to both the sign and magnitude of the Q-input to achieve four-quadrant division. The Y signal could if desired be reversed for the same purpose.

Figure 7:
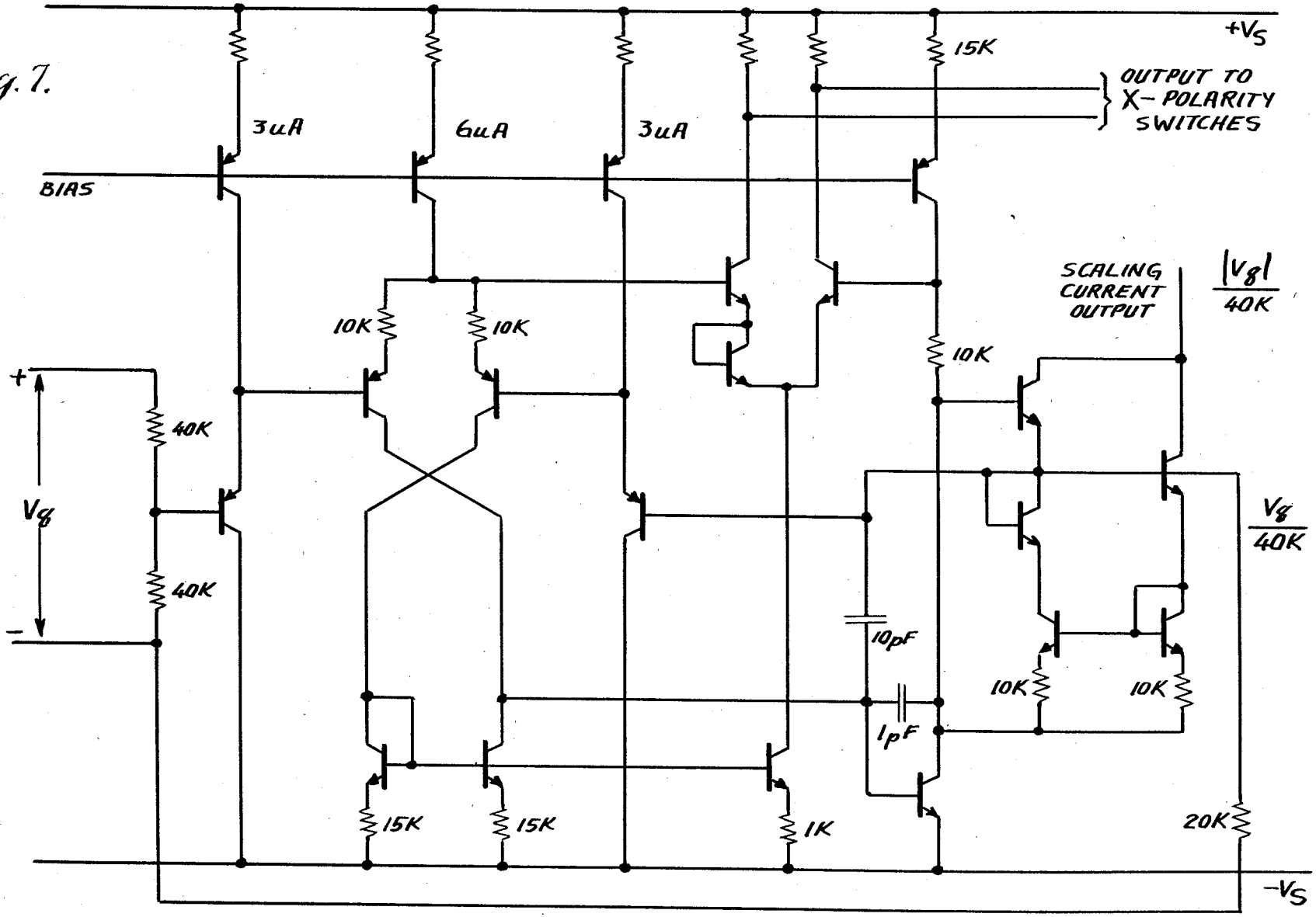
FIG. 7 shows specific circuit details of the arrangement of FIG. 6.

FIG. 7 shows certain details of the polarity control circuitry. It may be noted that lateral and vertical PNP transistors are used to provide the capability for accepting Q input voltages with a common mode range down to the $-V_s$ line (which thus can be grounded for single-supply operation). This capability is only possible for positive inputs(QA>QB).

Compensation has been provided for possible errors introduced by the finite alpha of the various transistors inserted into the signal paths. For example, the alpha of Q35 and Q36 is compensated by the very nearly equal alpha of the cascode in the feedback (Z) channel. These cascodes form part of the nonlinearity-compensation scheme, now to be described.

VOLTAGE-TO-CURRENT CONVERSION

It is well known that translinear circuits operate in the current-mode whereas practical signal interfaces are voltage-mode. Some means to translate between these two modes are thus commonly required in analog multiplier circuits. Practical demands require that such conversion be performed with a minimum of distortion (non-linearity).

Operational amplifiers can be used in some cases; for example, the Q-interface just discussed takes advantage of the high open-loop gain of an operational amplifier to ensure linear V-I conversion. However, speed penalties result when large amounts of feedback are used. Furthermore, op-amp circuits do not lend themselves very well to the provision of high-impedance differential inputs and otherwise highly-balanced operation.

In the past, voltage-to-current converters based on emitter degenerated stages have been the mainstay of this field. They exhibit marked nonlinearity, due to variation in the base-emitter voltages of the transistors, but for full-scale inputs of the order of ±10 V, with clipping levels of about ±13 V to ±14 V, the distortion amounts to 0.1% to 0.2% of full-scale. This can be reduced by the use of active feedback. See, for example, "A New Wideband Amplifier Technique", IEEE Journal of Solid-State Circuits, Vol. SC-3 No. 4, pp 353–365, December 1968, by B. Gilbert. Such arrangements use an identical V-I converter in the feedback path of the output operational amplifier, rather than simple resistive feedback. The nonlinearities cancel very well when both converters operate under the same signal conditions. In a multiplier, however, the latter condition does not, in general, apply. Nevertheless, a useful reduction in distortion can be achieved in this fashion in accordance with prior art techniques.

In the present case, higher accuracy was sought, and each V-I converter (X-, Y- and Z-) is arranged to be independently linear. Active feedback is still used, but primarily because it happens to also offer some other advantages in terms of flexibility.

Figure 8:
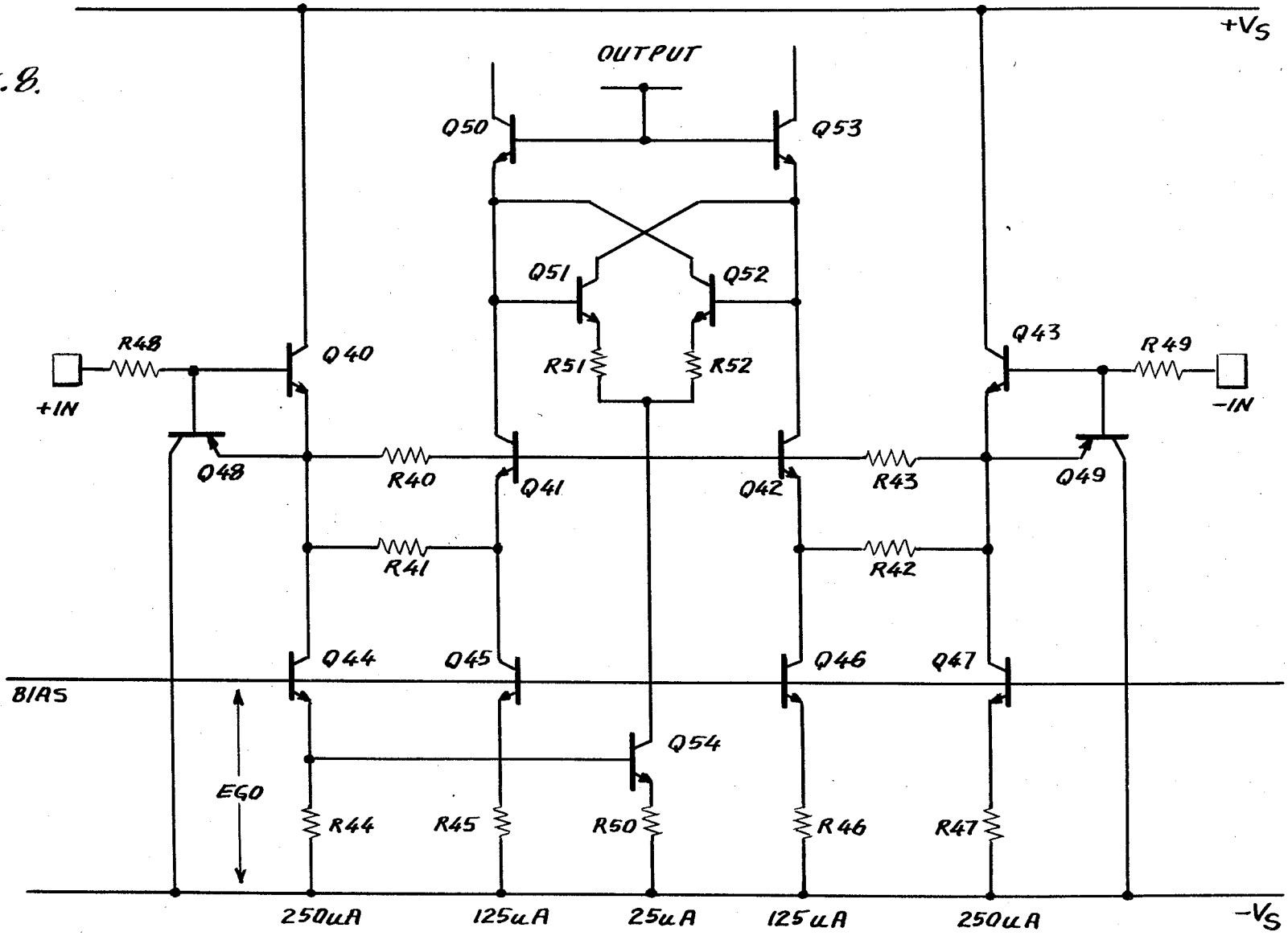
FIG. 8 is a circuit diagram of a voltage-to-current (V-I) converter.

FIG. 8 shows one of the three high-performance V-I converters used in a commercial embodiment of the invention. It avoids many of the dynamic limitations of conventional differential-input converters and includes error-correcting features which render it inherently linear.

It should be first noted that the output currents do not come, as is usually the case, from the outer transistors Q40, Q43, which now act primarily as emitter-followers to raise the input resistance. The full differential voltage is applied across resistors R40+R43, and thus the bases of the inner transistors Q41 and Q42 follow the midpoint of this input. Under zero-signal conditions, the collector currents of these devices are equal, and typically about 130 μA, the bias currents coming from Q45 and Q46. Also, all $V_{BE}$'s are equal. When the +IN terminal is positive, currents flow in R41 and R42 such as to reduce the collector current of Q41 and raise that of Q42. In the process, the $V_{BE}$'s of Q40–Q43 are no longer equal, and it can be shown that the net difference in the four $V_{BE}$'s causes distortion, by virtue of the fact that the signal voltages across R41 and R42 are less than they would ideally be, the deficit becoming proportionately more severe as Q40-Q43 approach the limits of their current ranges.

Now, the cascode transistors, shown here as Q50 and Q53 are carrying signal currents which relate directly to those in Q40-Q43, and it is a relatively easy matter to show that the differential voltage between the emitters of Q50 and Q53 is essentially one-half the deficit in the signal across R41 and R42 due to the differential $V_{BE}$'s of Q40-Q43. This voltage is sensed by an auxilliary V-I converter comprising Q51, Q52, R51 R52 biased by a current source Q53, R50, and re-injected into the signal path at the emitters of Q50 and Q53, but in antiphase. Under proper conditions of design, the cancellation of the $V_{BE}$-induced error voltages can be very good (to within a few parts-per-million in theory).

Cascode-compensation circuits similar to that described herein have been made before. For example, reference may be made to "A Cascode Amplifier Nonlinearity Correction Technique", *ISSCC Digest of Technical Papers,* Feburary 1981, by P. A. Quinn.

The present circuit (FIG. 8) differs from such prior art arrangement in one small, but significant respect: The collectors of the pair Q51, Q52 are not taken to the collectors of Q50, Q53 but rather to the emitters. This has important consequences for the present purposes, namely, it allows the double-use of devices already present in the overall scheme of the multiplier as the cascode pair. In the X-channel, it is the transistors in the polarity reversing switch (see FIG. 6); in the Y-channel it is the transistors in the output section of the multipler (Q3-Q6 in FIG. 2) which serve double-duty in this way. Note that in both cases it would have been impossible to have used the scheme as shown in the Quinn disclosure (referred to above) since his cascode transistors (Q3, Q4) are by-passed by the error-correcting signal, whereas the phasing of the output in each case in FIG. 8 varies depending on signal conditions.

Although preferred embodiments of the present invention have been described herein in detail, it is desired to emphasize that this is for the purpose of illustrating the principles of the invention, and should not necessarily be construed as limiting of the invention since it is apparent that those skilled in this art can make many modified arrangements of the invention without departing from the true scope thereof.

What is claimed is:

1. In a four-quadrant multiplier of the type comprising a first pair of transistors interconnected to handle one input of the multiplier; and second and third pairs of transistors interconnected with said first pair of transistors to form respective transistor quads to handle another input of the multiplier; each of said transistors having first and second main electrodes and a control electrode;

that improvement in such multiplier comprising:

circuit means applying adjustable PTAT compensation voltages to the control electrodes of at least one of said pairs of transistors to null inherent $V_{BE}$ mismatch, said circuit means comprising adjustable resistors connected to said control electrodes;

PTAT current sources connected to said resistors respectively to develop said compensating voltages;

said second and third transistor pairs being connected with common emitters which are coupled to said other multiplier input; and amplifier means connected to the remote ends of said resistors to drive said bases responsive to said one multiplier input.

2. In a four-quadrant multiplier of the type comprising a first pair of transistors interconnected to handle one input of the multiplier; and second and third pairs of transistors interconnected with said first pair of transistors to form respective transistor quads to handle another input of the multiplier;

that improvement in such multiplier comprising:

a differential amplifier responsive to said one input and having first and second output terminals;

means coupling said output terminals to the bases of said first pair of transistors respectively;

means coupling said first and second output terminals to the bases of said second pair of transistors respectively; and means coupling said first and second output terminals to the bases of said third pair of transistors respectively.

3. Apparatus as claimed in claim 2, including load means coupled to the collectors of said first pair of transistors; and means coupling the signal developed at said load means to the input of said differential amplifier to force the collector voltages to be equal.

4. Apparatus as claimed in claim 2, wherein said pairs of transistors are connected with common emitters; and current source means connected to the common emitters of said first pair of transistors.

5. Apparatus as claimed in claim 4, including means to vary the magnitude of current produced by said current source means, to provide for division as well as multiplication.

6. Apparatus as claimed in claim 2, wherein said differential amplifier comprises a fourth pair of transistors having their emitters serving as the amplifier input port;

first and second controllable current sources connected to said emitters to provide currents corresponding to said one input; and means coupling said emitters to the collectors of said first pair of transistors.

7. Apparatus as claimed in claim 6, including first and second load resistors connected to the collectors of said first pair of transistors respectively and providing common-mode control feedback.

8. Apparatus as claimed in claim 6, wherein said differential amplifier comprises a fifth pair of transistors having their emitters serving as the amplifier output port;

means coupling the bases of said fifth pair of transistors respectively to the collectors of said fourth pair of transistors; and third and fourth current sources coupled to the respective emitters of said fifth pair of transistors.

9. Apparatus as claimed in claim 8, including means coupling the emitters of said fifth pair of transistors to the respective bases of said first pair of transistors.

10. In a four-quadrant multiplier of the type comprising a first pair of transistors interconnected to handle one input of the multiplier; and second and third pairs of transistors interconnected with said first pair of transistors to form respective transistor quads to handle another input of the multiplier;

that improvement in such multiplier comprising:

means connecting the emitters of said first pair of transistors in common;

means supplying to the bases of said first pair of transistors differential signals corresponding to said one input;

a current source connected to said common emitters to produce a controlled current through said first pair of transistors; and means providing for varying the magnitude of current produced by said current source, to effect division as well as multiplication.

11. Apparatus as claimed in claim 10. including:

a differential amplifier responsive to said one input and having first and second output terminals coupled to the bases of said first pair of transistors respectively.

12. Apparatus as claimed in claim 11, including denominator control means producing a control signal of alterable sign and operable to set the magnitude of said current in accordance with the control signal magnitude.

13. Apparatus as claimed in claim 12, including means responsive to said sign and operable to set the polarity of one or the other of said multiplier inputs in accordance with such sign.

14. Apparatus as claimed in claim 13, wherein said sign responsive means comprises reversing switch means in the input circuit of said differential amplifier.

15. Apparatus as claimed in claim 11, including means responsive to the output of said differential amplifier for controlling differentially the bases of said second and third pairs of transistors.

16. Apparatus as claimed in claim 13, including an absolute value circuit for controlling the magnitude of current from said current source without regard to said sign.

17. Apparatus as claimed in claim 16, wherein said absolute value circuit is a full-wave rectifier.

18. In a four-quadrant multiplier of the type including a first pair of transistors interconnected to handle one input of the multiplier; second and third pairs of transistors interconnected with said first pair of transistors to form respective transistor quads to handle another input of said multiplier; and signal means connecting said first pair of transistors to said second and third pairs of transistors to effect a multiplication function;

said signal means between said first pair of transistors and said second and third pairs of transistors comprising for each transistor of said second and third pairs of transistors:

a first resistor of low ohmic value connected to the base of the corresponding transistor;

second resistor means connected in parallel with said first resistor;

said second resistor means comprising a trim resistor of moderate ohmic value in series with a fixed resistor of relatively high ohmic value;

a current source connected to the junction of said trim resistor and said fixed resistor;

the current from said current source flowing substantially through said trim resistor with only a small component flowing through said fixed resistor and said first resistor.

19. Apparatus as claimed in claim 18, wherein said first resistor is developed from an n+ diffusion in the formation of a monolithic chip.

20. Apparatus as claimed in claim 18, wherein said trim resistor comprises a generally elongate element having a pair of contacts at opposite sides at one end of the element;

the other end of said element extending away from said contacts so that in the untrimmed state, the majority of current flow is parallel to the two contacts.

21. Apparatus as claimed in claim 20, wherein coarse trimming is effected by cutting into the region between the contacts, starting at said one end; and fine trimming is effected by overshooting during the coarse trimming, and thereafter cutting into the other end of said element, from the direction opposite to the coarse trimming.

22. In a four-quadrant multiplier of the type comprising a first pair of interconnected transistors each with collector and base connected together to form diodes;

means supplying a first multiplier input to said first pair of transistors;

second and third pairs of transistors with common emitters and interconnected with said first pair of transistors to form respective transistor quads to effect a multiplier function;

means supplying a second multiplier input to said second and third pairs of transistors;

the improvement in said circuit which comprises;

buffer means comprising emitter-followers coupled in the interconnection between said first pair of transistors and said second and third pair of transistors; and current sources supplying to said emitter-followers bias currents set to minimize the effects of area mismatch of at least one of said pairs of transistors.

23. Apparatus as claimed in claim 22, wherein said emitter followers are connected between the emitters of said first pair of transistors and the bases of said second and third pairs of transistors.

24. In a four-quadrant multiplier of the type comprising a first pair of transistors each with its collector and base connected together to form diodes identified as Q1 and Q2; means supplying a first multiplier input to said first pair of transistors; second and third pairs of transistors with common emitters and identified as Q3, Q4, Q5 and Q6; means supplying a second multiplier input to said second and third pairs of transistors; and said second and third pairs of transistors being interconnected with said first pair of transistors to form respective transistor quads to effect a multiplier function;

that improvement in said multiplier comprising:

first, second, third and fourth emitter followers connected as buffers between the emitters of said first pair of transistors and the bases of said second and third pairs of transistors; said emitter followers being identified as Q11, Q12, Q13 and Q14;

first, second, third and fourth current sources coupled to the bases of said second and third pairs of transistors respectively and identified as I11, I12, I13 and I14;

the relationship between said current sources and the area-ratio factors of said transistors being as follows:

$$I11/I12=(A1.\ A12.\ A4/A2.\ A11.\ A3)$$

$$I14/I13=(A1.\ A13.\ A5/A2.\ A14.\ A6)$$

where the letter A represents the emitter area of the correspondingly numbered transistor.

25. For use in high-accuracy circuits such as V-I input converters for analog multipliers, a signal translation circuit having an output circuit including cascode compensation means which comprises:

a cascode first pair of transistors with their bases connected together;

a transimpedance formed by a second pair of transistors and a second pair of resistors, to allow the introduction of a controlled amount of nonlinearity in the differential signal path;

control signal means coupled to the bases of said second pair of transistors, circuit means providing a cross-quad connection between said pairs of transistors and said resistors wherein:

(a) the base of each of said second pair of transistors is connected to the emitter of a corresponding one of said first pair of transistors;

(b) the collector of each of said second pair of transistors is connected to the emitter of the opposite (non-corresponding) one of said first pair of transistors;

(c) said resistors are connected serially between the emitters of said second pair of transistors, with the resistor junction connected to a source of current; and output circuit means coupled to the collectors of said first pair of transistors.

26. Apparatus as claimed in claim 25, wherein said control signal means comprises:

a pair of input terminals;

a second pair of serially-connected resistors coupled between said input terminals;

a third pair of transistors having their bases connected to the common junction of said second pair of resistors;

the collectors of said third pair of transistors being coupled to the bases of said second pair of transistors; and current source means coupled to the emitters of said third pair of transistors.

27. The method of compensating $V_{BE}$ mismatch in a four-quadrant multiplier of the type comprising a first pair of transistors interconnected to handle one input of the multiplier and second and third pairs of transistors forming with said first pair of transistors respective transistor quads to handle another input of the multiplier; said method comprising:

connecting trimmable resistors to the bases of said second and third pairs of transistors;

each resistor being formed as an elongate element having its opposite sides at one end thereof connected between contacts;

flowing PTAT current through said resistors to develop PTAT compensating voltage at said bases; and trimming said resistors to provide for nulling of the distortion produced by $V_{BE}$ mismatch;

the trimming of said resistors being effected by a laser cut starting at said one end adjacent said contacts.

28. The method of claim 27, wherein said laser cut is continued up said elongate element until the correct compensation is slightly exceeded; and laser-cutting said element down from the other end thereof to provide a reverse fine adjustment of the compensation.

* * * * *